US008448672B2

(12) United States Patent
Shen et al.

(10) Patent No.: US 8,448,672 B2
(45) Date of Patent: May 28, 2013

(54) WEAVING MACHINE

(75) Inventors: Chien-Lung Shen, New Taipei (TW); Pei-Jing Chen, New Taipei (TW); Kun-Chuan Tsai, New Taipei (TW)

(73) Assignee: Taiwan Textile Research Institute, New Taipei (TW)

( * ) Notice: Subject to any disclaimer, the term of this patent is extended or adjusted under 35 U.S.C. 154(b) by 119 days.

(21) Appl. No.: 13/154,469

(22) Filed: Jun. 7, 2011

(65) Prior Publication Data

US 2012/0018029 A1 Jan. 26, 2012

(30) Foreign Application Priority Data

Jul. 21, 2010 (TW) ..... 99124008 A

(51) Int. Cl.
*D03D 41/00* (2006.01)
*D03D 15/00* (2006.01)

(52) U.S. Cl.
USPC ..... 139/11; 139/1 R

(58) Field of Classification Search
USPC ..... 139/11
See application file for complete search history.

(56) References Cited

U.S. PATENT DOCUMENTS 4,234,907 A * 11/1980 Daniel ..... 362/556
4,422,719 A * 12/1983 Orcutt ..... 385/123
5,027,259 A * 6/1991 Chujko ..... 362/582
5,183,323 A * 2/1993 Daniel ..... 362/556
5,568,964 A * 10/1996 Parker et al. ..... 362/556
6,072,619 A * 6/2000 Kiryuschev et al. ..... 359/245
6,480,649 B2 * 11/2002 Lee ..... 385/31
6,628,885 B1 * 9/2003 Wilkie et al. ..... 385/147
6,844,447 B2 * 1/2005 Zhong et al. ..... 548/543
6,851,844 B2 * 2/2005 Guy ..... 362/556
7,137,416 B2 * 11/2006 Brochier et al. ..... 139/420 R
7,144,830 B2 * 12/2006 Hill et al. ..... 442/205
7,234,853 B2 * 6/2007 Givoletti ..... 362/556
7,661,847 B2 * 2/2010 Wang ..... 362/249.16
7,682,060 B2 * 3/2010 Wang ..... 362/565
2001/0016819 A1 * 8/2001 Kolls ..... 705/1
2003/0156426 A1 * 8/2003 Givoletti ..... 362/556
2009/0169729 A1 * 7/2009 Lin et al. ..... 427/120
2011/0080688 A1 * 4/2011 Tang ..... 361/434
2012/0126258 A1 * 5/2012 Lee et al. ..... 257/88
2012/0276673 A1 * 11/2012 Wei et al. ..... 438/42

OTHER PUBLICATIONS http://en.wikipedia.org/wiki/Power_loom.*

* cited by examiner

*Primary Examiner* — Bobby Muromoto, Jr.
(74) *Attorney, Agent, or Firm* — Jianq Chyun IP Office

(57) ABSTRACT

A weaving machine for weaving a strong fabric on a surface of a linear light-emitting module is provided. The weaving machine includes a warp let-off mechanism, a drop wire, a plurality of heald frames, a picking mechanism, a beating-up mechanism, and a take-up mechanism. The warp let-off mechanism provides and transmits a plurality of warps and the linear light-emitting module. The heald eye of each heald frame allows the warps and the linear light-emitting module to pass through. The heald frames are located between the warp let-off mechanism and the beating-up mechanism. The take-up mechanism is suitable for adjusting and controlling latitude density of the strong fabric, wherein the take-up mechanism has a set of grooves corresponding to the linear light-emitting module.

9 Claims, 5 Drawing Sheets

WEAVING MACHINE

CROSS-REFERENCE TO RELATED APPLICATION

This application claims the priority benefit of Taiwan application serial no. 99124008, filed on Jul. 21, 2010. The entirety of the above-mentioned patent application is hereby incorporated by reference herein and made a part of this specification.

BACKGROUND OF THE INVENTION

1. Field of the Invention

The invention relates to a weaving machine, and more particularly to a weaving machine for weaving a strong fabric on a surface of a linear light-emitting module.

2. Description of Related Art

Under the development of technology, the textile industry is facing severe competition. Thus, textile manufacturers have to continue researching and developing new technology and diversified products to keep up with the competition. In recent years, besides the aesthetic demand towards textile products, people have also demanded various convenient and protective functions. With this trend, textile products with multi-functions have become the new hot products in the textile industry.

In conventional technology, multiple linear light-emitting modules with different structures have been, in succession, provided. Various linear light-emitting modules can be combined with different textile products, and can have different applications. No matter what the application is, the linear light-emitting modules still need to have an established strength to prevent the product from being damaged after the combination. Thus, by using PVC in conventional technology, the linear light-emitting modules have a sewing structure to increase the application of the linear light-emitting modules. However, the structure of the linear light-emitting module is not flexible, and it easily causes the light source of the linear light-emitting module to come off the body and cracks the PVC. The linear light-emitting module shows a deficiency in strength.

In current textile technology, if a strong fabric is weaved on the surface of the linear light-emitting module, when the linear light-emitting module is led to a weaving machine and during a subsequent roller take-up process, the light source of the linear light-emitting module is easily damaged by the weaving machine and the roller, causing the connection area of the light source and the conducting wire of the linear light-emitting module to be opened, or causing the light source to be directly damaged and incapable of emitting light. Obviously, weaving a strong fabric on a surface of a linear light-emitting module is not suitable to adopt in current weaving machines. Thus, how to weave a strong fabric on a surface of a linear light-emitting module and not damage the linear light-emitting module is a current problem that is trying to be solved.

SUMMARY OF THE INVENTION

The invention is directed to a weaving machine for weaving a strong fabric on a surface of a linear light-emitting module under the premise of not damaging the linear light-emitting module.

The invention is directed to a weaving machine for weaving a strong fabric on a surface of a linear light-emitting module. The weaving machine includes a warp let-off mechanism, a drop wire, a plurality of heald frames, a picking mechanism, a beating-up mechanism, and a take-up mechanism. The warp let-off mechanism provides and transmits a plurality of warps and the linear light-emitting module. The drop wire has an opening. Each heald frame respectively supports a plurality of vertical healds. Each heald has a heald eye allowing the warps and the linear light-emitting module to pass through, and the heald frames are suitable to drive the warps to divide into two warp layers. The picking mechanism is for transmitting a woof, so that the woof passes between the two warp layers. The beating-up mechanism is for driving the woof, so that the woof and the warps interweave and form the strong fabric. Herein, the heald frames are located between the warp let-off mechanism and the beating-up mechanism. The take-up mechanism is for adjusting and controlling a latitude density of the strong fabric. Herein, the take-up mechanism has a set of grooves corresponding to the linear light-emitting module.

In an embodiment of the invention, the warp let-off mechanism includes at least one warp beam and at least one back rest. The back rest corresponds to the warp beam. Herein, the warp beam and the back rest are suitable to provide and transmit the warps and the linear light-emitting module.

In an embodiment of the invention, the opening includes an arc-shaped inner margin contacting the linear light-emitting module.

In an embodiment of the invention, a part of the heald eyes includes an arc-shaped inner margin contacting the linear light-emitting module.

In an embodiment of the invention, a bore diameter of the part of the heald eye including the arc-shaped inner margin is greater than a thread diameter of the linear light-emitting module.

In an embodiment of the invention, the bore diameter of the part of the heald eye is $\phi 1$, and the thread diameter of the linear light-emitting module is $\phi 2$. Herein, $\phi 1=\phi 2+1$ millimeters.

In an embodiment of the invention, the take-up mechanism includes a first roller and a second roller. The first roller has a first groove. The second roller has a second groove. When the take-up mechanism takes-up the linear light-emitting module with a surface having the strong fabric, the linear light-emitting module is accommodated in the first groove and the second groove.

In an embodiment of the invention, a shortest distance between the first groove and the second groove is D, and the thread diameter of the linear light-emitting module is $\phi 2$. Herein, $\phi 2+0.3$ millimeters $\leqq D \leqq \phi 2+0.5$ millimeters.

In an embodiment of the invention, the beating-up mechanism includes a steel reed. A gap of the steel reed is G, and a thread diameter of the linear light-emitting module is $\phi 2$. Herein, $\phi 2+1$ millimeters $\leqq G \leqq \phi 2+1.5$ millimeters.

Based on the above, by using the weaving machine of the invention, the strong fabric can be woven on the surface of the linear light-emitting module without damaging the linear light-emitting module. Besides improving the strength of the linear light-emitting module, the weaving machine provides sewing advantages and a better feel for weaving.

In order to make the aforementioned and other features and advantages of the invention more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
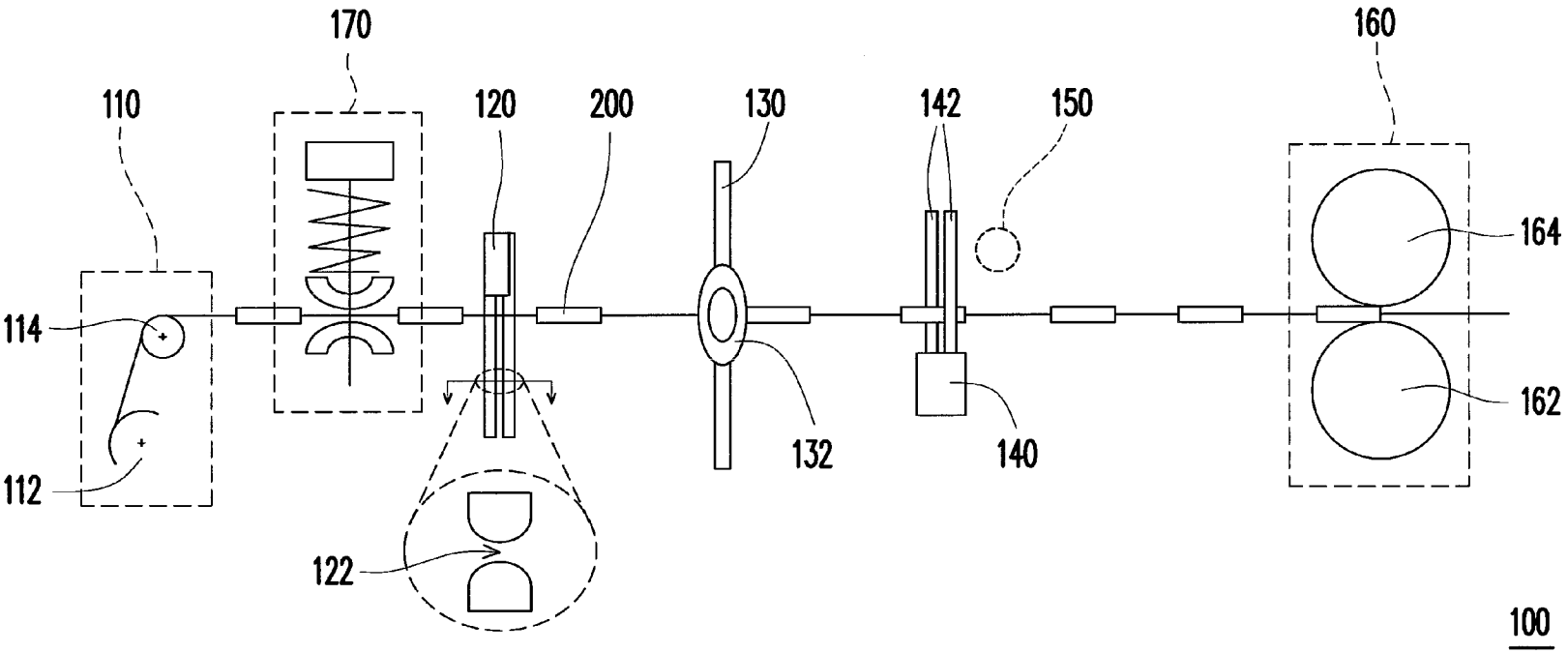
FIG. 1 is a schematic side view of the weaving machine according to an embodiment of the invention.

FIG. 1 is a schematic side view of the weaving machine according to an embodiment of the invention. Referring to FIG. 1, a weaving machine 100 of the present embodiment is suitable for weaving a strong fabric on a surface of a linear light-emitting module 200. As shown in FIG. 1, the weaving machine 100 includes a warp let-off mechanism 110, a drop wire 120, a plurality of heald frames 130, a picking mechanism 150, a beating-up mechanism 140, and a take-up mechanism 160.

In the present embodiment, the warp let-off mechanism 110 includes at least one warp beam 112 and at least one back rest 114, and the back rest 114 corresponds to the warp beam 112. The warp let-off mechanism 110 provides and transmits a plurality of warps and the linear light-emitting module 200, wherein the warp beam 112 and the back rest 114 are suitable to provide and transmit the warps and the linear light-emitting module 200.

The drop wire 120 has an opening 122. In the present embodiment, in order to prevent damage towards the linear light-emitting module 200 when weaving the strong fabric, the opening 122 of the drop wire 120 has an arc-shaped inner margin contacting the linear light-emitting module 200, as shown in FIG. 1.

Each heald frame 130 respectively supports a plurality of vertical healds (not shown), and each heald has a heald eye 132 allowing the warps and the linear light-emitting module 200 to pass through. The heald frames 130 are suitable to drive the warps to divide into two warp layers, wherein in order for a clear description, only the heald frame 130 for the linear light-emitting module 200 to pass through is shown. In the present embodiment, in order to prevent damage towards the linear light-emitting module 200 when weaving the strong fabric, the heald eye 132 that the linear light-emitting module 200 passes through is also designed to have an arc-shaped inner margin contacting the linear light-emitting module 200, as shown in FIG. 1. It should be noted that other heald eyes of the present embodiment that allow warps to pass through can be optionally designed with an arc-shaped inner margin according to need. In other words, in the present embodiment, a part of the heald eyes includes an arc-shaped inner margin contacting the linear light-emitting module 200.

The picking mechanism 150 is for transmitting a woof, so that the woof passes between the two warp layers. The beating-up mechanism 140 is for driving the woof, so that the woof and the warps interweave and form the strong fabric, wherein the heald frames 130 are located between the warp let-off mechanism 110 and the beating-up mechanism 140.

The take-up mechanism 160 is for adjusting and controlling a latitude density of the strong fabric, wherein the take-up mechanism 160 has a set of grooves corresponding to the linear light-emitting module 200, in order to prevent damage towards the linear light-emitting module 200 when weaving on the strong fabric, and it will be explained in detail later.

It should be noted that in order to allow the warps provided by the warp let-off mechanism 110 to maintain enough strain during weaving, a strain controlling mechanism 170 may be disposed between the warp let-off mechanism 110 and the drop wire 120, so as to control the strain of the warps to satisfy the conditions of weaving.

Figure 2:
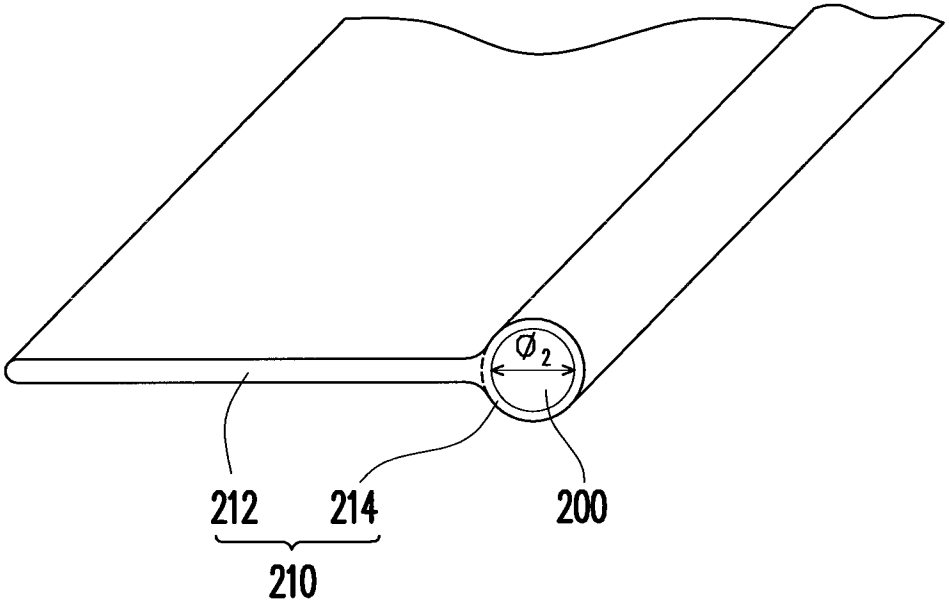
FIG. 2 is a schematic view of the linear light-emitting module covered by a strong fabric according to an embodiment of the invention.

FIG. 2 is a schematic view of the linear light-emitting module 200 covered by a strong fabric 210 according to an embodiment of the invention. Referring to FIG. 2, the strong fabric 210 of the present embodiment includes a sheath 214 and at least one sewing portion 212. The sheath 214 wraps the linear light-emitting module 200. The sewing portion 212 extends from the sheath 214. In addition, the strong fabric 210 is, for example, a white fabric or a colorful fabric. More specifically, the strong fabrics 210 may be fabricated by photoluminescence fabrics or fabrics with optical reflection. By selecting the color of the strong fabric in the present embodiment, the linear light-emitting module 200 can be allowed to show diverse colors, and thereby the application of the linear light-emitting module 200 is increased.

In an exemplary embodiment of the invention, by weaving the strong fabric to cover the linear light-emitting module, the strength and the friction coefficient of the linear light-emitting module can be improved to satisfy the conditions of yarn processing. Thus, the linear light-emitting module wrapped in yarn includes a light-emitting diode sprout thread so as to have sewing characteristics, and includes the weaving and wrapping structure to improve the strength and the friction coefficient of the linear light-emitting module and have a colorful structure formed by yarn.

In the present embodiment, a thread diameter of the linear light-emitting module 200 is $\phi 2$ for example. In the embodiment of FIG. 1, in order to prevent damage towards the linear light-emitting module 200 when weaving a strong fabric 210, the heald eye 132 that the linear light-emitting module 200 passes through has an arc-shaped inner margin contacting the linear light-emitting module 200, as shown in FIG. 1.

Figure 3:
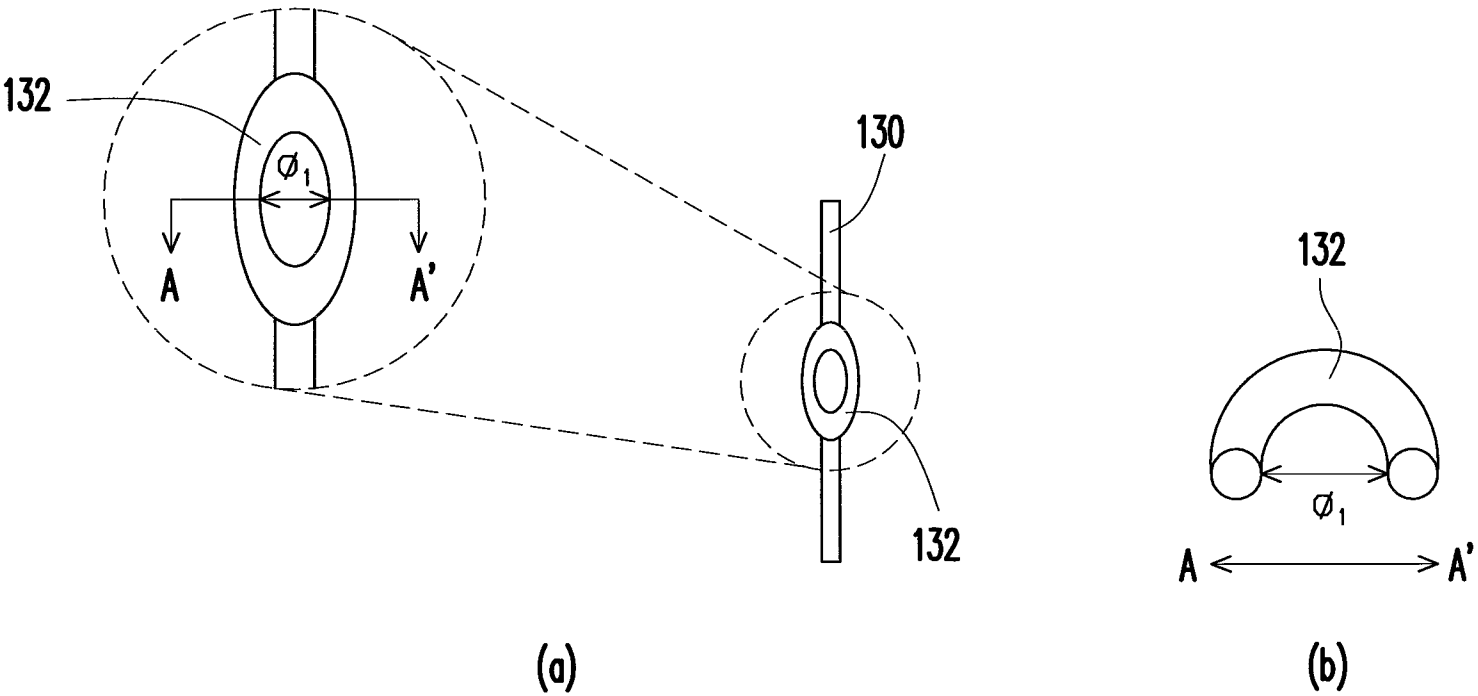
FIG. 3 is a schematic view of the heald frame that the linear light-emitting module passes through in FIG. 1.

FIG. 3 is a schematic view of the heald frame 132 that the linear light-emitting module 200 passes through in FIG. 1, wherein a bore diameter of the heald eye 132 in FIG. 3(*a*) is $\phi 1$, and FIG. 3(*b*) is a cross-sectional view of the heald eye 132 along AA'.

Referring to FIG. 1 through FIG. 3, in the present embodiment, as clearly seen in FIG. 3(*b*), the heald eye 132 has an arc-shaped inner margin, and the bore diameter of the heald eye 132 is greater than a thread diameter of the linear light-emitting module 200. For example, if the bore diameter of the heald eye 132 is $\phi 1$, and the thread diameter of the linear light-emitting module 200 is $\phi 2$, then the two have a relationship of $\phi 1 = \phi 2 + 1$ millimeters, and thus, the linear light-emitting module 200 can pass through the heald eye 132 successfully without being damaged.

Figure 4:
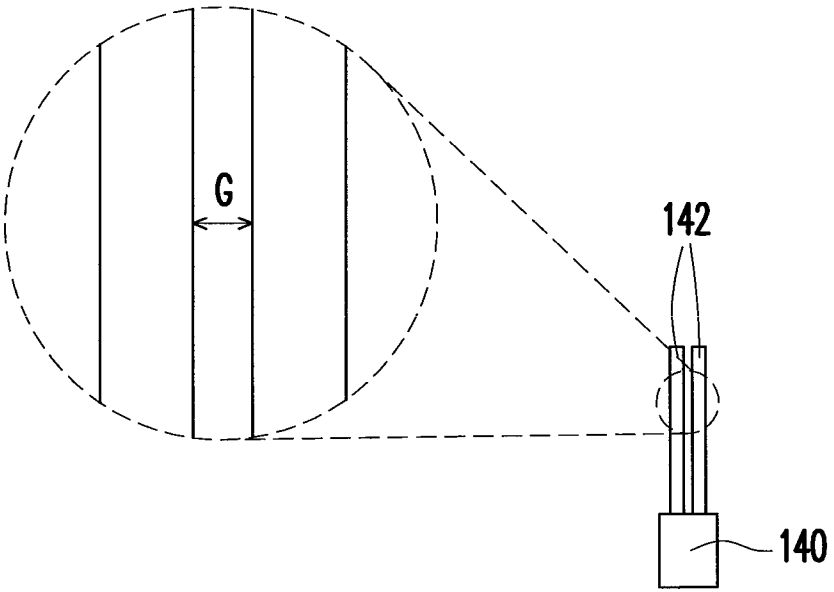
FIG. 4 is a schematic view of the beating-up mechanism of FIG. 1.

FIG. 4 is a schematic view of the beating-up mechanism 140 of FIG. 1. Referring to FIGS. 1 and 4, the beating-up mechanism 140 of the present embodiment includes a steel reed 142. In the present embodiment, if a gap of the steel reed 142 is G, and the thread diameter of the linear light-emitting module 200 is $\phi 2$, then the two have a relationship of $\phi 2 + 1$ millimeters $\leqq G \leqq \phi 2 + 1.5$ millimeters, and thus, the linear light-emitting module 200 can pass through the steel reed 142 successfully without being damaged.

Figure 5:
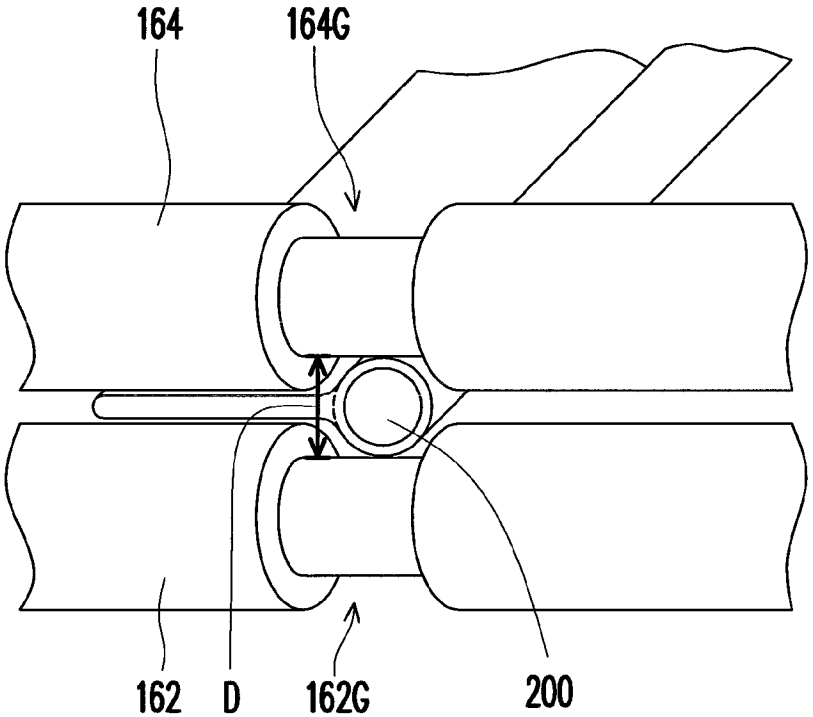
FIG. 5 is a schematic view of the take-up mechanism of FIG. 1.

FIG. 5 is a schematic view of the take-up mechanism 160 of FIG. 1. Referring to FIGS. 1 and 5, the take-up mechanism 160 of the present embodiment includes a first roller 162 and a second roller 164. The first roller 162 has a first groove

162G. The second roller 164 has a second groove 164G. When the take-up mechanism 160 takes-up the linear light-emitting module 200 with a surface having the strong fabric 210, the linear light-emitting module 200 is accommodated in the first groove 162G and the second groove 164G. Thus, besides adjusting and controlling a latitude density of the strong fabric, the take-up mechanism 160 of the present embodiment can further prevent damage towards the linear light-emitting module 200 when weaving on a strong fabric 210.

In the present embodiment, if the shortest distance between the first groove and the second groove is D, and the thread diameter of the linear light-emitting module 200 is $\phi 2$, then the two have a relationship of $\phi 2+0.3$ millimeters $\leqq D \leqq \phi 2+0.5$ millimeters, such that the linear light-emitting module 200 can pass through the take-up mechanism 160 successfully without being damaged.

To sum up, in the embodiment of the invention, through the design of at least the drop wire, the beating-up mechanism, and the take-up mechanism, the weaving machine of the invention can weave a strong fabric on a surface of a linear light-emitting module under the premise of not damaging the linear light-emitting module. Besides improving the strength of the linear light-emitting module, the weaving machine provides sewing advantages and a better feel for weaving.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A weaving machine, adapted to weave a strong fabric on a surface of a linear light-emitting module, the weaving machine comprising:

a warp let-off mechanism providing and transmitting a plurality of warps and the linear light-emitting module;

a drop wire having an opening;

a plurality of heald frames, wherein each of the heald frames respectively supports a plurality of vertical healds, each of the healds has a heald eye allowing the warps and the linear light-emitting module to pass through, and the heald frames are adapted to drive the warps to divide into two warp layers;

a picking mechanism adapted to transmit a woof, such that the woof passes between the two warp layers;

a beating-up mechanism adapted to drive the woof, such that the woof and the warps interweave and form the strong fabric, wherein the heald frames are located between the warp let-off mechanism and the beating-up mechanism; and a take-up mechanism adapted to adjust and control a latitude density of the strong fabric, wherein the take-up mechanism has a set of grooves corresponding to the linear light-emitting module, wherein the take-up mechanism comprises:

a first roller having a first groove; and a second roller having a second groove, wherein when the take-up mechanism takes-up the linear light-emitting module with a surface having the strong fabric, the linear light-emitting module is accommodated in the first groove and the second groove.

2. The weaving machine as claimed in claim 1, wherein the warp let-off mechanism comprises:

at least one warp beam; and at least one back rest corresponding to the warp beam, wherein the warp beam and the back rest are adapted to provide and transmit the warps and the linear light-emitting module.

3. The weaving machine as claimed in claim 1, wherein the opening includes an arc-shaped inner margin contacting the linear light-emitting module.

4. The weaving machine as claimed in claim 1, wherein a part of the heald eyes includes an arc-shaped inner margin contacting the linear light-emitting module.

5. The weaving machine as claimed in claim 4, wherein a bore diameter of the part of the heald eye including the arc-shaped inner margin is greater than a thread diameter of the linear light-emitting module.

6. The weaving machine as claimed in claim 5, wherein the bore diameter of the part of the heald eye is $\phi 1$,and the thread diameter of the linear light-emitting module is $\phi 2$, and $\phi 1=\phi 2+1$ millimeters.

7. The weaving machine as claimed in claim 1, wherein a shortest distance between the first groove and the second groove is D, and a thread diameter of the linear light-emitting module is $\phi 2$, and $\phi 2+0.3$ millimeters $\leqq D \leqq \phi 2+0.5$ millimeters.

8. The weaving machine as claimed in claim 1, wherein the beating-up mechanism comprises a steel reed, a gap of the steel reed is G, and a thread diameter of the linear light-emitting module is $\phi 2$, and $\phi 2+1$ millimeters $\leqq G \leqq \phi 2+1.5$ millimeters.

9. The weaving machine as claimed in claim l, wherein the strong fabric is fabricated by photoluminescence fabrics or fabrics with optical reflection.

* * * * *